US005365891A

United States Patent [19]

Hanning

[11] Patent Number: 5,365,891

[45] Date of Patent: Nov. 22, 1994

[54] INLET WATER TURBULATOR FOR A WATER HEATER

[75] Inventor: David M. Hanning, Montgomery, Ala.

[73] Assignee: Rheem Manufacturing Company, New York, N.Y.

[21] Appl. No.: 168,635

[22] Filed: Dec. 16, 1993

[51] Int. Cl.[5] ..... F24H 1/00

[52] U.S. Cl. ..... 122/382; 126/361

[58] Field of Search ..... 122/235.17, 380, 382–383, 122/384, 390; 126/361

[56] References Cited

U.S. PATENT DOCUMENTS

| | | | |
|---|---|---|---|
| 2,123,809 | 7/1938 | Seitz | 137/21 |
| 2,602,465 | 7/1952 | Goehring | 137/582 |
| 2,766,200 | 10/1956 | Kaufman | 204/197 |
| 3,465,123 | 9/1969 | Harris | 219/328 |
| 3,762,395 | 10/1973 | Taylor | 126/350 R |
| 4,263,879 | 3/1981 | Lindahl | 122/159 |
| 4,505,231 | 3/1985 | Syler | 122/159 |
| 4,549,525 | 10/1985 | Narang | 126/361 |
| 4,838,211 | 6/1989 | Vago | 122/159 |
| 4,858,563 | 8/1989 | Perry | 122/382 |
| 4,870,927 | 10/1989 | Sundheimer | 122/412 |
| 4,898,124 | 2/1990 | Granberg et al. | 122/382 |
| 4,898,150 | 2/1990 | Lewis | 126/361 |
| 4,964,394 | 10/1990 | Threatt | 126/361 |

FOREIGN PATENT DOCUMENTS

| | | | |
|---|---|---|---|
| 132112 | 10/1985 | European Pat. Off. | 122/382 |

*Primary Examiner*—Henry A. Bennett
*Assistant Examiner*—William C. Doerrler
*Attorney, Agent, or Firm*—Konneker Bush Hitt & Chwang

[57] ABSTRACT

An inlet water turbulator body is coaxially secured within the lower end of an inlet water supply dip tube vertically disposed with the storage tank portion of a water heater. A spaced plurality of vertically spiraling passages extend through the turbulator body and are operative, in response to discharge of hot water from the storage tank through its outlet fitting, to receive pressurized inlet water within the dip tube and discharge the received water from a the lower end of the turbulator body in a water discharge pattern that impinges upon the lower tank end wall with substantial vertically directed and horizontally swirling force components to thereby facilitate the dislodgement of sediment from the lower tank end wall.

30 Claims, 2 Drawing Sheets

INLET WATER TURBULATOR FOR A WATER HEATER

BACKGROUND OF THE INVENTION

The present invention generally relates to water heaters, and more particularly relates to apparatus for producing inlet water turbulence in a water heater storage tank for the purpose of inhibiting the buildup of sediment on the bottom interior surface of the storage tank.

Residential water heaters conventionally comprise a storage tank enclosed in an insulated jacket structure and adapted to receive and store pressurized water for on-demand delivery to plumbing fixtures, such as sinks, showers and tubs, to which the tank is operatively connected. Cold water from a pressurized source thereof is typically delivered into the storage tank through the open lower end of a dip tube that extends vertically through the tank. Water delivered to the tank is heated by fuel-fired or electric heating means operatively associated with the tank, and a portion of the heated water is periodically discharged from the tank, through an outlet fitting thereon, to the plumbing fixtures to which the water heater is connected, As a quantity of hot water is discharged from the tank in this manner, a corresponding quantity of unheated water is automatically delivered into the interior of the tank via its cold water supply dip tube.

As is well known, a problem typically encountered in water heaters of this general type is the buildup, over time, of sediment on the bottom interior wall of the storage tank. This buildup is the result of undissolved particulate matter delivered with the cold makeup water into the tank interior and settling onto the bottom tank wall. In an attempt to inhibit this undesirable sediment buildup a variety of inlet water agitating or turbulator devices have been previously proposed for connection in the cold water inlet supply line (which may be the previously mentioned vertical dip tube or a piping structure entering the side of the tank).

In general, these devices are designed to create an agitated cold water discharge pattern within the tank that serves to increase the time during which the incoming particulate matter is held in suspension above the bottom tank wall before settling onto such wall, and also to stir up particulate matter that settled onto the bottom tank wall during previous hot water demand periods. This, in turn, is designed to permit an increased quantity of particulate matter to be discharged through the tank outlet fitting during periods of cold water supply inflow to the tank.

Previously proposed inlet water agitating and turbulator devices of this type generally described above commonly have a variety of problems, limitations and disadvantages associated therewith such as mechanical complexity, relatively high fabrication and installation costs, and less than optimum agitation patterns. It is accordingly an object of the present invention to provide a water heater with improved inlet water turbulator apparatus that eliminates or at least substantially reduces the above-mentioned problems, limitations and disadvantages commonly associated with conventional turbulator and agitating devices of the type generally described above.

SUMMARY OF THE INVENTION

In carrying out principles of the present invention, in accordance with preferred embodiments thereof, a specially designed inlet water turbulator is incorporated in a water heater having a storage tank with vertically spaced apart top and bottom walls. Tube means, preferably a vertically extending dip tube, are provided for flowing pressurized water into the storage tank to be heated therein by a suitable heating means portion of the water heater. Heated water in the storage tank may be selectively discharged through an outlet fitting on the tank.

The tube means have an inner discharge end portion centered about a vertical axis and spaced upwardly apart from the bottom storage tank wall in a facing relationship therewith. The inlet water turbulator functions to facilitate the dislodgement of sediment on the bottom storage tank wall by water discharged from the inner end portion of the tube means and includes a turbulator body secured to the discharge end portion of the tubing means and having a lower end portion facing and spaced upwardly apart from the bottom storage tank wall.

In one embodiment thereof, the turbulator body is a solid cylindrical molded plastic member and has an upper end portion coaxially press-fitted into the lower end of the tubing means, with the balance of the turbulator body projecting downwardly from the bottom end of the tubing means. At least one vertically spiraling passage means extends through the interior of the otherwise solid turbulator body. Each spiraling passage means is operative to receive pressurized water from the interior of the tubing means and discharge the received water from the lower end portion of the turbulator body in the form of a plurality of a water stream impinging on the bottom storage tank wall with substantial vertically directed and horizontally swirling force components.

In another embodiment thereof the turbulator body includes a molded plastic elongated rectangular strip which is laterally twisted in a spiraling manner about its longitudinal axis and is coaxially press-fitted into the lower end of the tubing means. Centrally molded onto the lower end of the turbulator body is a generally frustroconically shaped baffle portion that forms with the lower end of the tubing means a single annular opening through which water is discharged from the tubing means. Water exiting the tubing means passes downwardly through a pair of spiraling passages extending through the turbulator body, and outwardly bounded by the interior side surface of the tubing means, and is then discharged through the single annular discharge opening in the form of a spiraling water stream impinging on the bottom storage tank wall with substantial vertically directed and horizontally swirling force components.

DETAILED DESCRIPTION

Figure 1:
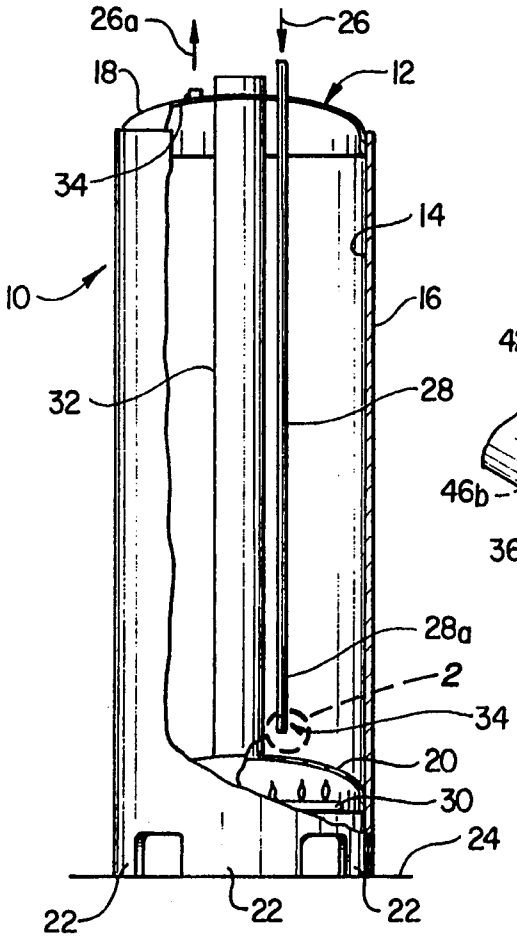
FIG. 1 is a partially cut away side elevational view of a representative water heater having a vertical dip tube through which cold water is supplied to the interior of the storage tank portion of the water heater, the lower end of the dip tube having secured thereto a specially designed inlet water turbulator device embodying principles of the present invention.

Illustrated in FIG. 1 is a water heater 10 embodying principles of the present invention. Water heater 10 includes a vertically elongated cylindrical metal storage tank 12 having a side wall 14 outwardly circumscribed by an insulated jacket structure 16; an upwardly domed top end wall 18; an upwardly domed bottom end wall 20; and a circumferentially spaced series of bottom end legs 22 that support the water heater 10 on a horizontal surface such as the illustrated floor 24.

Cold water 26 from a pressurized source thereof is supplied to the interior of the storage tank 12 through a vertically oriented plastic dip tube 28 extending through the top tank end wall 18 and having a lower end portion 28*a* that is upwardly spaced a short distance apart from the bottom tank end wall 20. Cold water 26 delivered into the tank 12 via the dip tube 28 is stored in the tank and heated by heating means representatively in the form of a fuel burner structure 30 disposed beneath the bottom tank end wall 20. Hot combustion products generated by the operation of the burner structure 30 are flowed into an external vent stack (not shown) via a vertically extending flue 32 centrally disposed within the tank 12 and extending at its top end through the top tank end wall 18. While the illustrated water heater 10 is representatively a fuel-fired water heater, it could alternatively be an electric water heater.

On demand, a quantity of hot water 26*a* is flowed outwardly from the storage tank 12 through an outlet fitting 34 mounted on the top tank end wall 18. Simultaneously with this hot water outflow a corresponding quantity of pressurized cold water 26 is automatically flowed into the tank 12 via the dip tube 28. In order to inhibit the undesirable buildup of sediment on the bottom tank end wall 20, the present invention provides a specially designed inlet water turbulator device 34 that is secured to the lower end portion 28*a* of the plastic dip tube 28.

Figure 2:
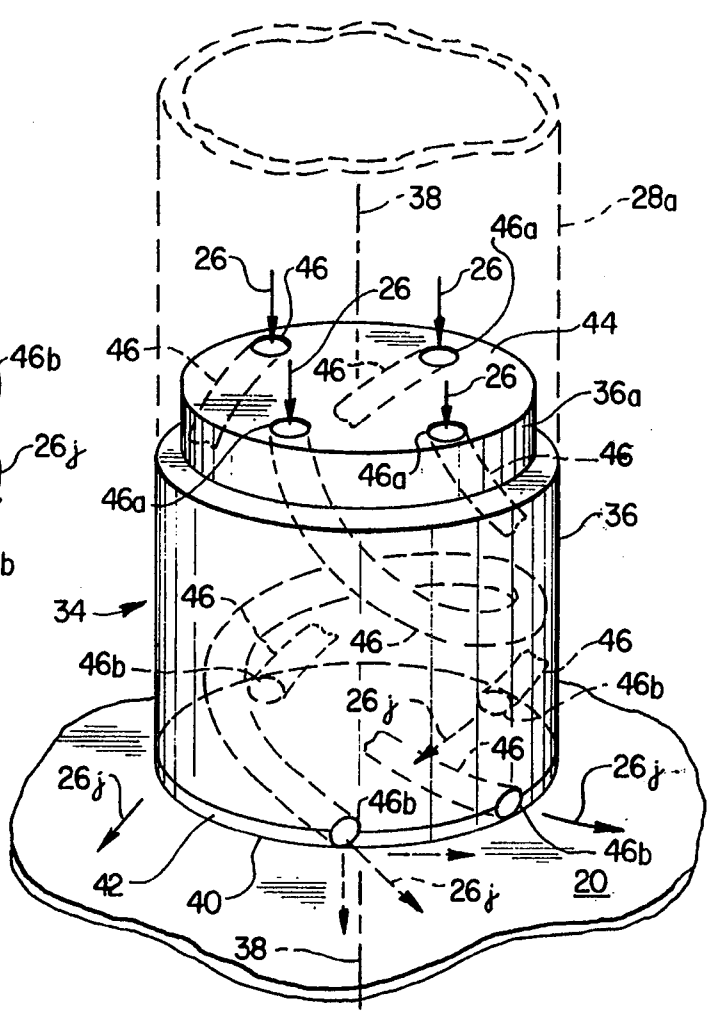
FIG. 2 is an enlarged scale perspective detail view of the circled area "2" in FIG. 1, and illustrates a lower end portion of the dip tube and the turbulator device secured thereto.
Figure 3:
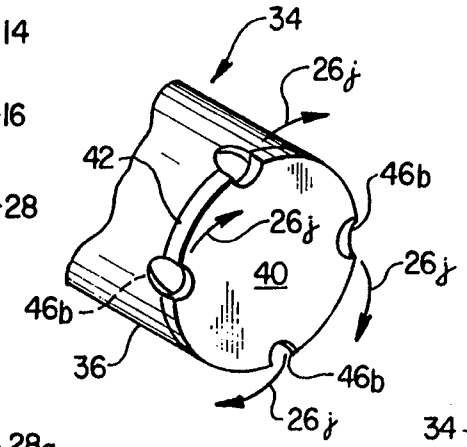
FIG. 3 is a reduced scale bottom end perspective view of a lower end portion of the turbulator device shown in FIG. 2.

With reference now to FIGS. 2 and 3, the turbulator device is of a one piece molded plastic construction and has cylindrical body portion 36 centered about a longitudinal axis 38 and having a bottom end 40 which is chamfered, as at 42, around its periphery. Body portion 36 has a diameter essentially identical to the outer diameter of the dip tube 28. A reduced diameter cylindrical top end portion 36*a* of the turbulator body 36 is closely and coaxially received in the lower dip tube end portion 28*a* and is fixedly and sealingly secured therein by, for example, a suitable adhesive material or a sonic welding process.

The top end surface 44 of the turbulator device 34 has formed in a peripheral portion thereof a circumferentially spaced plurality (representatively four in number) of cold water inlet openings 46*a*, and a corresponding number of circumferentially spaced cold water discharge openings 46*b* are formed in the peripheral chamfer area 42 at the lower end of the turbulator device 10. The inlet openings 46*a* are connected to their associated discharge openings 46*b* by a spaced apart, parallel series of four internal flow passages 46 that spiral, in a corkscrew fashion, circumferentially and downwardly through the device 10 from its inlet openings 46*a* to its outlet openings 46*b* as best illustrated in FIG. 2. The internal flow passages 46 are formed by a suitable coring process used during the molding of the plastic turbulator device 10.

Representatively, each internal flow passage 46 downwardly spirals through a full 360° rotational arc from its top inlet opening 46*a* to its bottom discharge opening 46*b* so that each discharge opening 46*b* is on the same side of the device as its associated inlet opening 46*a*. However, the rotational arcs of the passages 46 could be smaller or greater as desired. Moreover, the total number of internal flow passages 46 could be increased or decreased as desired, as long as least one flow passage 46 is formed in the turbulator device 10.

As a quantity of hot water 26*a* is upwardly discharged through the tank outlet fitting 34 (see FIG. 1), a corresponding quantity of pressurized cold water 26 enters the turbulator device inlet openings 46*a* (see FIG. 2), is forced downwardly through the spiraling internal device flow passages 46, and is discharged from the lower device end openings 46*b* in the form of cold water jets 26*j*. According to a key aspect of the present invention, each of the four cold water jets 26*j*, due to the path configuration of the internal flow passages 46, has a substantial downward velocity component $V_d$ as well as a substantial swirling tangential velocity component $V_t$. Thus, the cold water discharged from the turbulator device 10 strikes the bottom tank end wall 20 with both a direct vertical impingement force component and a swirling horizontal force component. This combined swirling and direct impingement action of the discharged cold water striking the bottom tank end wall provides an improved, concentrated agitating action on sediment which may have accumulated on this wall, thereby tending to efficiently dislodge at least some of the sediment and permit it to be desirably withdrawn from the tank 12 through the tank outlet fitting 34.

As can readily be seen from the foregoing, the inlet water turbulator device 34 of the present invention is of a simple and inexpensive construction, is very easy to install on the dip tube 28, and has a very compact configuration with a maximum diameter essentially identical to that of the dip tube. While the device 10 has been representatively illustrated as having a circular cross-section along its vertical length, and having an upper end portion insertable into and securable within a lower end portion of the dip tube 28, it will be readily appreciated by those skilled in this particular art that a variety of design modifications could be made to the turbulator device if desired. As but a few examples, the upper end of the device could be configured to fit over the lower dip tube end instead of being received therein, the device (at least along the portion thereof extending below the lower dip tube end) could have a noncircular cross-section, and the device could be alternatively configured to permit essentially the entire device to be received in the lower end of the dip tube.

A second embodiment 50 of the previously described turbulator device 34 is illustrated in FIGS. 4–7. The turbulator device 50 is of a molded plastic construction and has an elongated, rectangular strip-shaped body 52 which has upper and lower ends 52*a*, 52*b* and is laterally twisted about its longitudinal axis 54 in a manner such that the opposite side edges 56, 58 spiral about the axis 54 beneath the untwisted upper end 52*a* of the body 52. Extending transversely outwardly from the opposite sides of the upper body end portion 52*a* are a pair of flange portions 60 and 62. For purposes later described, a frustroconical baffle portion 64 is centrally molded on the bottom end of the body 52. The baffle member 64 has a downwardly and radially outwardly sloping side surface 66, and a base diameter less than the inner diameter of the lower dip tube end portion 28*a*.

Figure 4:
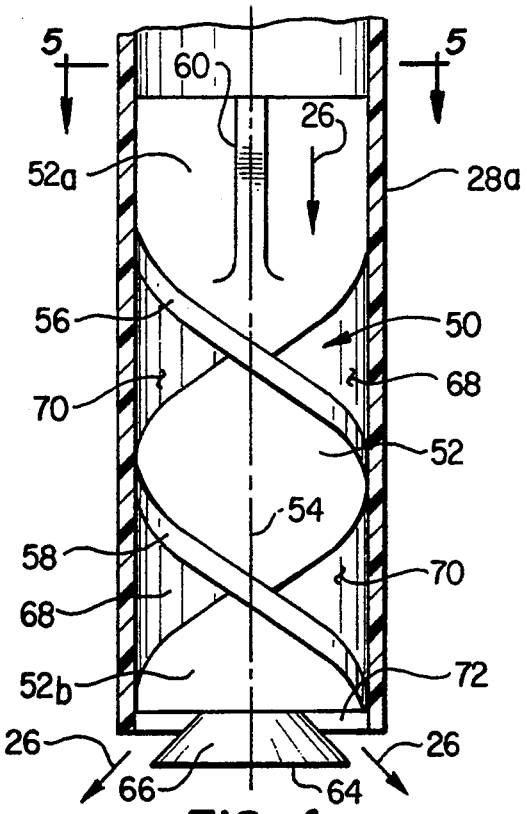
FIG. 4 is a cross-sectional view through a lower end portion of the dip tube and elevationally illustrating a second embodiment of the turbulator device press-fitted into the lower dip tube end portion.
Figure 5:
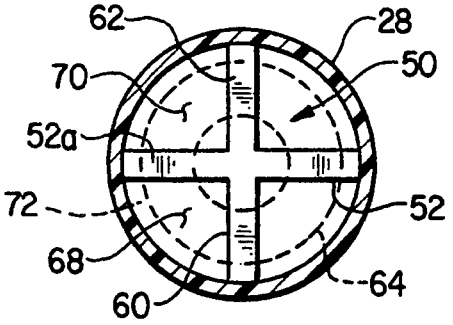
FIG. 5 is a cross-sectional view through the dip tube taken along line 5—5 of FIG. 4.
Figure 7:
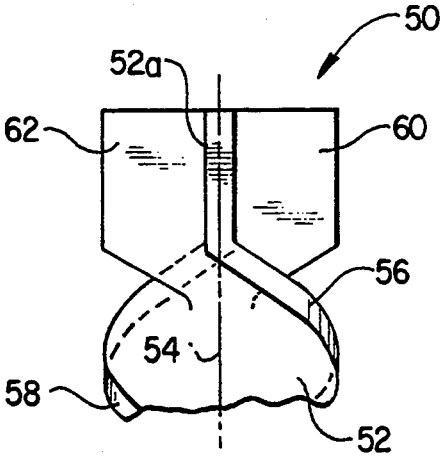
FIG. 7 is a partial left side elevational view of the second turbulator device embodiment in its FIG. 6 orientation.
Figure 6:
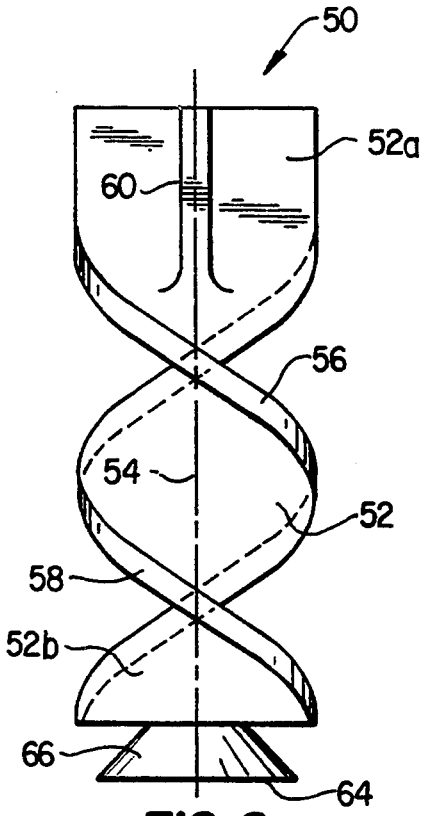
FIG. 6 is a side elevational view of the second turbulator device embodiment removed from the dip tube.

The turbulator device 50, as illustrated in FIGS. 4 and 5, is coaxially inserted into the lower dip tube end portion 28*a* with the turbulator baffle portion 64 projecting downwardly beyond the lower end of the dip tube. The outer side edges 56, 58 of the turbulator body 52, and the outer side edges of the flange portions 60 and 62 are positioned to engage the interior side surface of the dip tube. After the insertion of the turbulator body into the dip tube, the flange portions 60, 62 are sonically welded to the inner side surface of the dip tube to fixedly retain the turbulator device 50 within the lower end portion 28*a* of the dip tube 28.

The inserted turbulator device body 52 forms within the lower dip tube end portion 28*a* two inlet water delivery passages 68 and 70 that pass downwardly through the device body 52, spiral about its axis 54, and are outwardly bounded by the inner side surface of the lower dip tube end portion 28*a*. At their lower ends the passages 68, 70 open outwardly through a single annular discharge space 72 formed between the lower end of the dip tube 28 and the baffle portion 64 at the lower end of the turbulator device 50.

As a quantity of hot water 26*a* is upwardly discharged through the tank outlet fitting 34 (see FIG. 1), a corresponding quantity of pressurized cold water 26 downwardly enters the turbulator device 50, is forced downwardly through the spiraling internal device flow passages 68 and 70, and is discharged through the single annular opening 72 in the form of a water discharge stream 26.

The cold water discharge stream 26, due to the path configuration of the turbulator body flow passages 68 and 70, has (like the previously described cold water jets 26*j*) a substantial downward velocity component as well as a substantial swirling tangential velocity component. Thus, the cold water discharged from the turbulator device 50 (as in the case of the previously described turbulator device 34) strikes the bottom tank end wall 20 with both a direct vertical impingement force component and a swirling horizontal force component.

The foregoing detailed description is to be clearly understood as being given by way of illustration and example only, the spirit and scope of the present invention being limited solely by the appended claims.

What is claimed is:

1. Water heater apparatus comprising:

a storage tank having vertically spaced apart top and bottom walls;

tube means through which pressurized water may be flowed into said storage tank for heating therein, said tube means extending inwardly through a wall portion of said storage tank and having an inner discharge end portion centered about a vertical axis and spaced upwardly apart from said bottom storage tank wall in a facing relationship therewith;

heating means for heating water flowed into said storage tank through said tube means;

outlet means through which heated water may be discharged from said storage tank; and turbulator means for facilitating the dislodgement of sediment on said bottom storage tank wall by water discharged from said tubing means, said turbulator means including:

a turbulator body secured to said discharge end portion of said tubing means and having a lower end portion facing and spaced upwardly apart from said bottom storage tank wall, and at least one vertically spiraling passage means extending through said turbulator body for receiving pressurized water from the interior of said tubing means and discharging the received water from said lower end portion of said turbulator body in the form of a water stream impinging on said bottom storage tank wall with substantial vertically directed and horizontally swirling force components.

2. The water heater apparatus of claim 1 wherein:

said tube means comprise a vertically extending dip tube member.

3. The water heater apparatus of claim 1 wherein:

said turbulator body is of a one piece molded plastic construction.

4. The water heater apparatus of claim 1 wherein:

said turbulator body has a generally solid cylindrical configuration and has an upper end portion coaxially secured within said inner discharge end portion of said tube means.

5. Water heater apparatus comprising:

a storage tank having vertically spaced apart top and bottom walls;

tube means through which pressurized water may be flowed into said storage tank for heating therein, said tube means extending inwardly through a wall portion of said storage tank and having an inner discharge end portion centered about a vertical axis and spaced upwardly apart from said bottom storage tank wall in a facing relationship therewith;

heating means for heating water flowed into said storage tank through said tube means;

outlet means through which heated water may be discharged from said storage tank; and turbulator means for facilitating the dislodgement of sediment on said bottom storage tank wall by water discharged from said tubing means, said turbulator means including:

a turbulator body secured to said discharge end portion of said tubing means and having a lower end portion facing and spaced upwardly apart from said bottom storage tank wall, said turbulator body having a generally solid cylindrical configuration and having an upper end portion coaxially secured within said inner discharge end portion of said tube means, said upper end portion of said turbulator body having an upper end surface with at least one inlet opening therein, said lower end portion of said turbulator body having a peripheral portion with at least one discharge opening therein, and at least one vertically spiraling passage means extending through said turbulator body for receiving pressurized water from the interior of said tubing means and discharging the received water from said lower end portion of said turbulator body in the form of a water stream impinging on said bottom storage tank wall with substantial vertically directed and horizontally swirling force components, said at least one vertically spiraling passage means extending internally through said turbulator body between said turbulator body inlet and discharge openings.

6. The water heater apparatus of claim 5 wherein:

said upper end surface of said turbulator body has a circumferentially spaced plurality of inlet openings therein, said lower end portion of said turbulator body has a chamfered bottom peripheral edge portion, said turbulator body has a plurality of discharge openings circumferentially spaced around said chamfered bottom peripheral edge portion, and said turbulator means have a plurality of vertically spiraling passage means extending through said turbulator body between said inlet openings and said discharge openings.

7. The water heater apparatus of claim 1 wherein:

each of said at least one vertically spiraling passage means spirals through a total rotational arc of approximately 360°.

8. Water heater apparatus comprising:

a storage tank having vertically spaced apart top and bottom walls;

tube means through which pressurized water may be flowed into said storage tank for heating therein, said tube means extending inwardly through a wall portion of said storage tank and having an inner discharge end portion centered about a vertical axis and spaced upwardly apart from said bottom storage tank wall in a facing relationship therewith;

heating means for heating water flowed into said storage tank through said tube means;

outlet means through which heated water may be discharged from said storage tank; and turbulator means for facilitating the dislodgement of sediment on said bottom storage tank wall by water discharged from said tubing means, said turbulator means including:

a turbulator body secured to said discharge end portion of said tubing means and having a lower end portion facing and spaced upwardly apart from said bottom storage tank wall, said turbulator body having a generally solid cylindrical configuration and having an upper end portion coaxially secured within said inner discharge end portion of said tube means, said upper end portion of said turbulator body having an upper end surface with four circumferentially spaced inlet openings therein, said lower end portion of said turbulator body having a chamfered bottom peripheral edge portion with four circumferentially spaced discharge openings therein, and four vertically spiraling passage means extending through said turbulator body between said inlet openings and said discharge openings for receiving pressurized water from the interior of said tubing means and discharging the received water from said lower end portion of said turbulator body in the form of a water stream impinging on said bottom storage tank wall with substantial vertically directed and horizontally swirling force components.

9. Water heater apparatus comprising:

a storage tank having vertically spaced apart top and bottom walls;

tube means through which pressurized water may be flowed into said storage tank for heating therein, said tube means extending inwardly through a wall portion of said storage tank and having an inner discharge end portion centered about a vertical axis and spaced upwardly apart from said bottom storage tank wall in a facing relationship therewith;

heating means for heating water flowed into said storage tank through said tube means;

outlet means through which heated water may be discharged from said storage tank; and turbulator means for facilitating the dislodgement of sediment on said bottom storage tank wall by water discharged from said tubing means, said turbulator means including:

a turbulator body secured to said discharge end portion of said tubing means and having a lower end portion facing and spaced upwardly apart from said bottom storage tank wall, said turbulator body having a generally solid cylindrical configuration and having an upper end portion coaxially secured within said inner discharge end portion of said tube means, said upper end portion of said turbulator body having an upper end surface with a circumferentially spaced plurality of inlet openings therein, said lower end portion of said turbulator body having a chamfered bottom peripheral edge portion with a circumferentially spaced plurality of discharge openings therein, and a plurality of vertically spiraling passage means extending through said turbulator body between said inlet openings and said discharge openings for receiving pressurized water from the interior of said tubing means and discharging the received water from said lower end portion of said turbulator body in the form of a water stream impinging on said bottom storage tank wall with substantial vertically directed and horizontally swirling force components, said plurality of vertically spiraling passage means being parallel to one another along their lengths and being equally spaced around said vertical axis of said inner discharge end portion of said tube means.

10. The water heater apparatus of claim 1 wherein:

each of said at least one vertically spiraling passage means is disposed within the vertical footprint of said inner discharge end portion of said tube means.

11. The water heater apparatus of claim 1 wherein:

said turbulator body has an elongated, strip like configuration, is laterally twisted in a spiraling manner along its length, and is longitudinally received in said discharge end portion of said tubing means.

12. The water heater apparatus of claim 11 wherein:

said turbulator body is fixedly secured in said discharge end portion of said tubing means.

13. Water heater apparatus comprising:

a storage tank having vertically spaced apart top and bottom walls;

tube means through which pressurized water may be flowed into said storage tank for heating therein, said tube means extending inwardly through a wall portion of said storage tank and having an inner discharge end portion centered about a vertical axis and spaced upwardly apart from said bottom storage tank wall in a facing relationship therewith;

heating means for heating water flowed into said storage tank through said tube means;

outlet means through which heated water may be discharged from said storage tank; and turbulator means for facilitating the dislodgement of sediment on said bottom storage tank wall by water discharged from said tubing means, said turbulator means including:

a turbulator body secured to said discharge end portion of said tubing means and having a lower end portion facing and spaced upwardly apart from said bottom storage tank wall, and at least one vertically spiraling passage means extending through said turbulator body for receiving pressurized water from the interior of said tubing means and discharging the received water from said lower end portion of said turbulator body in the form of a water stream impinging on said bottom storage tank wall with substantial vertically directed and horizontally swirling force components, said turbulator body having an elongated, strip like configuration, being laterally twisted in a spiraling manner along its length, and being longitudinally received in said discharge end portion of said tubing means, said turbulator body having a lower end from which a generally frustroconical central baffle portion downwardly projects, said baffle portion forming with said inner discharge end portion of said tube means a single annular discharge openings through which said water stream may exit said tube means.

14. An inlet water turbulator connectable to the bottom discharge end of a vertically oriented water heater inlet dip tube and comprising:

a generally cylindrical body longitudinally extending along a central axis and having an upper end portion coaxially connectable to the dip tube discharge end, and a lower end portion spaced apart from said upper end portion along said central axis; and at least one passage extending internally through said body, each of said at least one passage being spiraled about said central axis and opening outwardly through said upper and lower end portions of said body, each of said at least one passage having a discharge end portion downwardly sloped at a substantial angle relative to a plane transverse to said central axis in a manner such that pressurized water exiting said discharge end portion has a substantial downwardly directed velocity component as well as a substantial circumferentially swirling velocity component centered about said central axis.

15. The inlet water turbulator of claim 14 wherein:

said body is of a one piece molded plastic construction.

16. The inlet water turbulator of claim 14 wherein:

said upper end portion of said body is diametrically reduced relative to the balance of said body and has an upper end surface, and each of said at least one passage opens outwardly at an end thereof through a peripheral portion of said upper end surface.

17. An inlet water turbulator connectable to the discharge end of a water heater inlet dip tube and comprising:

a generally cylindrical body longitudinally extending along a central axis and having an upper end portion coaxially connectable to the dip tube discharge end, and a lower end portion spaced apart from said upper end portion along said central axis, said lower end portion of said body having a bottom end surface joined to an outer side surface thereof by a chamfered peripheral edge portion; and at least one passage extending internally through said body, each of said at least one passage being spiraled about said central axis and opening outwardly through said upper and lower end portions of said body, each of said at least one passage opening outwardly at ends thereof generally through said chamfered peripheral edge portion.

18. The inlet water turbulator of claim 14 wherein:

each of said at least one passage spirals about said central axis through a total rotational arc of approximately 360°.

19. An inlet water turbulator connectable to the discharge end of a water heater inlet dip tube and comprising:

an elongated, generally strip shaped body portion extending along a longitudinal axis and being laterally twisted in a spiraling manner along its length about said longitudinal axis, said body portion having spiraling side edge portions and being coaxially securable within the discharge end of the dip tube in a manner positioning said side edge portions against the inner side surface of the dip tube to thereby create within the discharge end of the dip tube a separated pair of spiraling water discharge passages, said body portion further having upper and lower ends; and a generally frustroconical baffle portion coaxially secured to said lower end of said body portion and configured to form with the dip tube discharge end portion an annular discharge opening with which lower ends of the water discharge passages communicate.

20. The inlet water turbulator of claim 19 wherein:

said body portion is configured to be coaxially inserted into and fixedly secured within the dip tube discharge end portion.

21. The inlet water turbulator of claim 20 wherein:

said inlet water turbulator is of a one piece molded plastic construction.

22. The inlet water turbulator of claim 21 further comprising:

a pair of transverse flange portions positioned on opposite sides of said upper end of said body portion and having outer side edges positioned and configured to engage the interior side surface of the dip tube discharge end portion when said body portion is inserted into said dip tube discharge end portion.

23. Water heater apparatus comprising:

a storage tank having vertically spaced apart top and bottom walls;

a vertically oriented water inlet dip tube extending inwardly through said top storage tank wall, having a bottom end facing and spaced upwardly apart from said bottom storage tank wall, and being adapted to flow pressurized water from a source thereof into said storage tank to be heated therein;

heating means for heating water flowed into said storage tank through said dip tube;

outlet means through which heated water may be selectively discharged from said storage tank;

a turbulator body extending along an axis, being coaxially secured to said bottom dip tube end, and having a lower end portion disposed in a facing, upwardly spaced relationship with said bottom storage tank wall; and at least one vertically spiraling passage means extending through said turbulator body for receiving pressurized water from the interior of said dip tube and discharging the received water from said lower end portion of said turbulator body in the form of a water stream having substantial vertically downward and horizontally swirling velocity components.

24. The water heater apparatus of claim 23 wherein:

said turbulator body has a cylindrical configuration, an upper end portion of said turbulator body is coaxially secured within said bottom dip tube end and has an upper end surface, and each of said at least one passage means extends internally through said turbulator body, opens outwardly at an upper end thereof through said upper end surface of said upper end portion of said turbulator body, and opens outwardly at a lower end thereof through a peripheral portion of said lower end portion of said turbulator body.

25. Water heater apparatus comprising:

a storage tank having vertically spaced apart top and bottom walls;

a vertically oriented water inlet dip tube extending inwardly through said top storage tank wall, having a bottom end facing and spaced upwardly apart from said bottom storage tank wall, and being adapted to flow pressurized water from a source thereof into said storage tank to be heated therein;

heating means for heating water flowed into said storage tank through said dip tube;

outlet means through which heated water may be selectively discharged from said storage tank;

a cylindrical turbulator body extending along an axis, an upper end portion of said turbulator being coaxially secured to said bottom dip tube end and having an upper end surface, said turbulator body having a lower end portion disposed in a facing, upwardly spaced relationship with said bottom storage tank wall, said lower end portion of said turbulator body having a chamfered annular peripheral edge portion at its lower end; and at least one vertically spiraling passage means extending through said turbulator body for receiving pressurized water from the interior of said dip tube and discharging the received water from said lower end portion of said turbulator body in the form of a water stream having substantial vertically downward and horizontally swirling velocity components, each of said at least one passage means extending internally through said turbulator body and opening outwardly at an upper end thereof through said upper end surface of said upper end portion of said turbulator body, each of said at least one passage means opening outwardly at a lower end thereof through said chamfered annular peripheral edge portion.

26. The water heater apparatus of claim 23 wherein:

said turbulator body is of a one piece molded plastic construction.

27. The water heater apparatus of claim 23 wherein:

each of said at least one passage means vertically spirals through a total rotational arc of approximately 360°.

28. The water heater apparatus of claim 23 wherein:

said turbulator body has an elongated, strip like configuration, is laterally twisted in a spiraling manner along its length, and is longitudinally received in said bottom end of said dip tube.

29. The water heater apparatus of claim 28 wherein:

said turbulator body is fixedly secured within said bottom end of said dip tube.

30. Water heater apparatus comprising:

a storage tank having vertically spaced apart top and bottom walls;

a vertically oriented water inlet dip tube extending inwardly through said top storage tank wall, having a bottom end facing and spaced upwardly apart form said bottom storage tank wall, and being adapted to flow pressurized water from a source thereof into said storage tank to be heated therein;

heating means for heating flowed into said storage tank through said dip tube;

outlet means through which heated water may be selectively discharged from said storage tank;

a turbulator body extending along an axis, being coaxially and fixedly secured within said bottom dip tube end, and having a lower end portion disposed in a facing, upwardly spaced relationship with said bottom storage tank wall; and at least one vertically spiraling passage means extending through said turbulator body for receiving pressurized water from the interior of said dip tube and discharging the received water from said lower end portion of said turbulator body in the form of a water stream having substantial vertically downward and horizontally swirling velocity components, said turbulator body having an elongated, strip like configuration, and being laterally twisted in a spiraling manner along its length, said turbulator body further having a lower end from which a generally frustroconical central baffle portion downwardly projects, said baffle portion forming with said bottom end of said dip tube a single annular discharge opening through which said water stream may exit said dip tube.

* * * * *